US009111419B2

(12) United States Patent
Tarantino

(10) Patent No.: US 9,111,419 B2
(45) Date of Patent: Aug. 18, 2015

(54) BLACKJACK GAME WITH BONUS FEATURE

(71) Applicant: Elia Rocco Tarantino, Las Vegas, NV (US)

(72) Inventor: Elia Rocco Tarantino, Las Vegas, NV (US)

(73) Assignee: ROYAL SUITE BLACKJACK, LLC, Las Vegas, NV (US)

( * ) Notice: Subject to any disclaimer, the term of this patent is extended or adjusted under 35 U.S.C. 154(b) by 40 days.

(21) Appl. No.: 14/087,272

(22) Filed: Nov. 22, 2013

(65) Prior Publication Data

US 2015/0024821 A1 Jan. 22, 2015

Related U.S. Application Data

(63) Continuation-in-part of application No. 13/946,077, filed on Jul. 19, 2013, now Pat. No. 9,053,611.

(51) Int. Cl.
*G07F 17/32* (2006.01)

(52) U.S. Cl.
CPC ..... *G07F 17/3258* (2013.01)

(58) Field of Classification Search
USPC ..... 463/12, 13, 22
See application file for complete search history.

(56) References Cited

U.S. PATENT DOCUMENTS

| | | | | |
|---|---|---|---|---|
| 6,231,445 | B1 | 5/2001 | Acres | |
| 6,656,040 | B1 | 12/2003 | Brosnan et al. | |
| 6,769,984 | B2 | 8/2004 | Duhamel et al. | |
| 6,814,665 | B2 | 11/2004 | Seelig et al. | |
| 7,032,901 | B2 | 4/2006 | Perrie et al. | |
| 7,090,579 | B2 | 8/2006 | Tarantino | |
| 7,258,611 | B2 | 8/2007 | Bigelow, Jr. et al. | |
| 7,740,245 | B2 | 6/2010 | Tarantino | |
| 8,002,620 | B2 | 8/2011 | Nicely et al. | |
| 8,062,124 | B2 | 11/2011 | Jaffe | |
| 8,235,780 | B2 | 8/2012 | Nicely | |
| 8,308,550 | B2 | 11/2012 | Filipour et al. | |
| 8,317,597 | B2 | 11/2012 | Taylor | |
| 8,388,437 | B2 | 3/2013 | Nicely et al. | |
| 8,414,379 | B2 | 4/2013 | Nicely et al. | |
| 8,449,362 | B2 * | 5/2013 | Jackson | 463/13 |
| 2005/0124402 | A1 | 6/2005 | Miller | |
| 2007/0135193 | A1 | 6/2007 | Nicely | |
| 2008/0113704 | A1 * | 5/2008 | Jackson | 463/13 |
| 2008/0227517 | A1 | 9/2008 | O'Neal et al. | |

(Continued)

OTHER PUBLICATIONS

Al Moe, How to Play the Royal Match Blackjack Bonus Bet. About.com. Retrieved from http://casinogambling.about.com/od/blackjack101/a/Royal-Match-Blackjack-Bonus-Bet-How-To . . . , 1 page, no date, printed on Nov. 19, 2013.

(Continued)

*Primary Examiner* — Pierre E Elisca
(74) *Attorney, Agent, or Firm* — Weide & Miller, Ltd.

(57) ABSTRACT

A bonus event for Blackjack card games is provided. The bonus event has two or more designated bonus element, such as card hands. If one of the bonus elements is achieved as the result of play of a first Blackjack game, the bonus event is triggered. A bonus award is paid to the player if the player receives remaining required bonus elements as a result of the play of additional Blackjack games during the bonus period. The game is preferably played against a dealer at a video Blackjack machine and offers the player the opportunity for awards for each Blackjack game win and one or more additional bonus awards.

10 Claims, 5 Drawing Sheets

(56) References Cited

U.S. PATENT DOCUMENTS

| | | | | |
|---|---|---|---|---|
| 2011/0275427 | A1 | 11/2011 | Filipour et al. | |
| 2012/0289298 | A1 | 11/2012 | Nicely | |
| 2013/0260855 | A1 * | 10/2013 | Jackson | 463/13 |

OTHER PUBLICATIONS

Rules of Contract Rummy—How to Play Contract Rummy. (n.d.). Rummy.com. Retrieved from http://rummy.com/contractrummy.html, 3 pages, Copyright 2005-2013, printed on Nov. 19, 2013.

Online High Streak European Blackjack Gold. (n.d.). Wildjackcasino.com. Retrieved from http://www.wildjackcasino.com/high-streak-blackjack.html, 3 pages, Copyright 2006, printed on Nov. 19, 2013.

High Streak Blackjack, Blackjack-Authority.com. Retrieved from http://blackjack-authority.com/rules/high-streak-blackjack.html, 1 page, Copyright 2008, printed on Nov. 19, 2013.

Yahtzee. Cornell.edu. Retrieved from http://www.math.cornell.edu/~mec/2006-2007/Probability/Yahtzee.htm, 5 pages, no date, printed on Nov. 19, 2013.

* cited by examiner

BLACKJACK GAME WITH BONUS FEATURE

RELATED APPLICATION DATA

This application is a continuation-in-part of U.S. application Ser. No. 13/046,077, filed Jul. 19, 2013.

FIELD OF THE INVENTION

The present invention relates to Blackjack and other casino-style games.

BACKGROUND OF THE INVENTION

Blackjack is a popular casino game. In its traditional form, the game is played at a table using physical playing cards.

In recent years, the game has been implemented at gaming machines in video form. However, video Blackjack has not been very popular. One reason is that the game generally has a very low payback percentage as compared, for example, to games such as video poker and slots. For example, video Blackjack games might pay only 1:1 for a winning Blackjack hand (as compared to 3:2 or 6:5 in traditional table play) and might only have a game payback percentage of 84%. This contrasts with video poker and slot games which commonly have payback percentages of 94-99%. Thus, while players may generally enjoy playing video Blackjack, the low rate of return makes the game much less attractive to players than other games.

One way to increase the payback percentage for video Blackjack is to increase the payout for winning Blackjack hands, such as from 1:1 to 3:2 or even 2:1. However, this adjustment still does not add much excitement to the game.

A simple and effect way for increasing the excitement associated with Blackjack, thus increasing the desire of the player to play the game, is desired.

SUMMARY OF THE INVENTION

Aspects of the invention comprise methods of playing and presenting games. Other embodiments of the invention comprise systems and/or devices for presenting games.

One embodiment of the invention comprises a method of presenting games at a gaming machine comprising the machine-implemented steps of accepting a wager, presenting a first Blackjack game including displaying a player card hand and a house card hand; determining an outcome of the first Blackjack game; if the outcome of the first Blackjack game is a winning outcome, awarding a Blackjack game award to the player; determining if a triggering event has occurred, wherein if a triggering event has occurred, activating a bonus event having a bonus period, the bonus event resulting in a bonus award if the player achieves at least one bonus element as a result of play of one or more Blackjack games during the bonus period; and presenting one or more second Blackjack games, including awarding a Blackjack game award to the player for each winning outcomes of the one or more second Blackjack games, and if the player achieves the at least one bonus element during the bonus period, awarding at least one additional bonus award to the player.

In one embodiment, the at least one bonus element comprise two or more Blackjack game hands. In a preferred embodiment, the hands comprise Blackjack hands comprising two cards having a total card count of 21.

In one embodiment, the triggering event comprises achieving one of the bonus elements, such as one hand when the bonus elements comprise Blackjack hands.

In one embodiment of the invention, bonus elements may be received by either the player or the dealer.

In accordance with one preferred embodiment of the invention, Blackjack games have an associated bonus event. The bonus event defines a plurality of Blackjack hands. If one of the hands is received as a result of the play of a Blackjack game, then the bonus event is triggered. If the remaining Blackjack hands are received during the bonus period, a bonus award is awarded in addition to any payouts or awards for winning outcomes of the individual Blackjack games played by the player.

In one embodiment, if a player is dealt a card which comprises one of the cards of one of the bonus outcomes then the player is allowed to re-use that card in one or more additional second hands. The player's first hand and each additional second hand is then finalized and evaluated for winning outcomes and to determine if that outcome comprised one of the bonus outcomes.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise methods of playing and presenting games. Other embodiments of the invention comprise systems and/or devices for presenting games.

One embodiment of the invention comprises a game which has a bonus feature. In a preferred embodiment of the invention, the game is a video Blackjack game, wherein when a bonus triggering event occurs, a bonus period of time is provided for receiving one or more bonus winning elements such as a number of different Blackjack hands.

Figure 1:
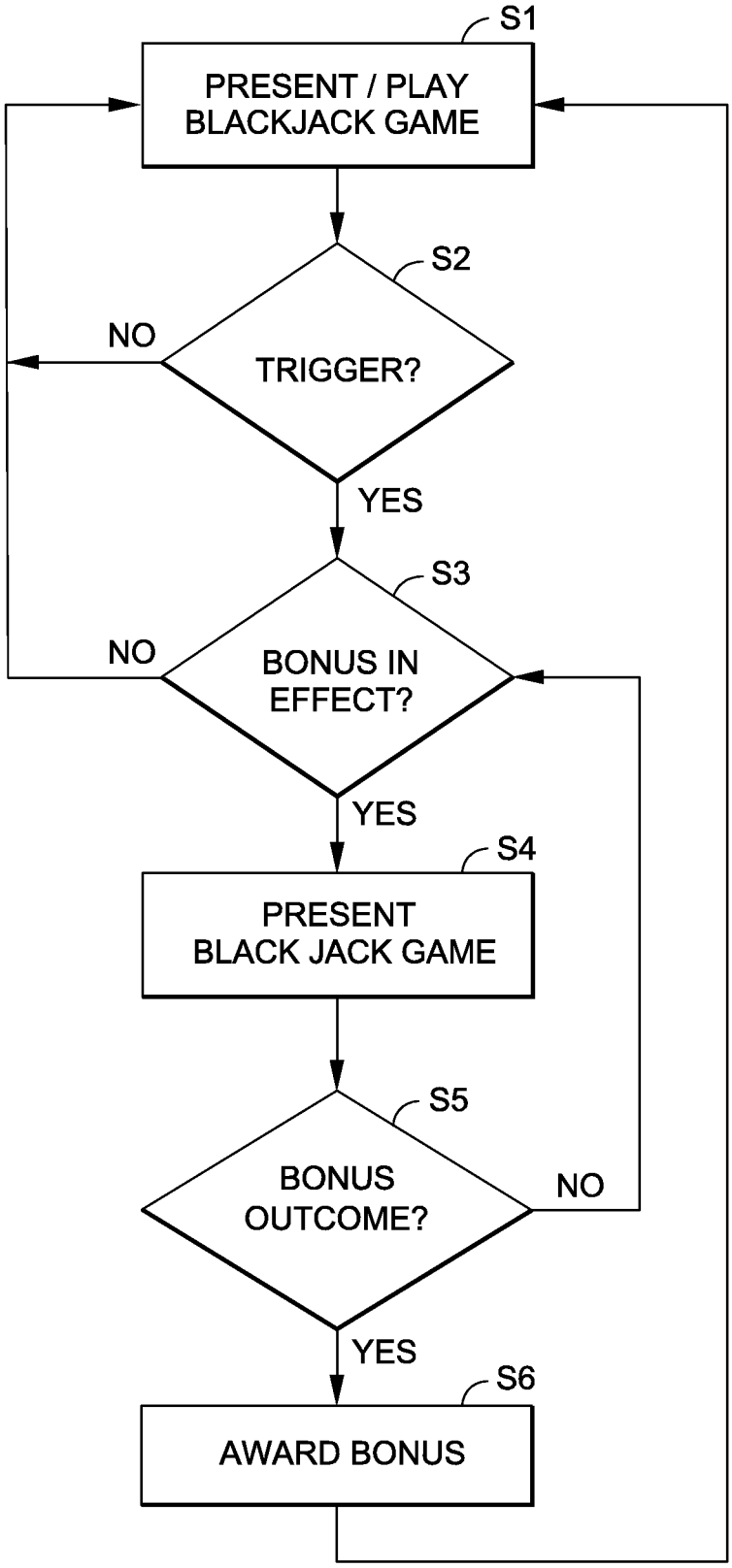
FIG. 1 is a flowchart of a game method in accordance with an embodiment of the invention.

One embodiment of the invention will be described with reference to FIG. 1. In a first step S1, a game of Blackjack is presented. The Blackjack game may be presented in various fashions, as is well known in the art. In particular, a number of variations of Blackjack games are known. Some examples of Blackjack games are described below.

In one embodiment, games of the invention are preferably presented as wager-based games. As such, the player may be required to place a wager, bet or ante in order to play the Blackjack game. The amount of the wager may vary, and in one embodiment may be no less than a pre-set minimum amount such as $0.10, $0.25 or even $1 or $5. The wager might be placed as moneys, points, credits having monetary value or the like.

Once the player has placed any required wager, two cards are dealt to the player. The cards may be dealt in a variety of manners. In the case of a gaming machine, the cards may be generated via random selection and displayed as video images. In the case of a table, the cards may be dealt from a deck or set of physical playing cards, including from a shoe. The cards dealt to each player may be dealt face up, face down, or a combination thereof.

Preferably, the two cards are dealt to the dealer or house, one card face up and the other face down. In other embodiments, the dealer's or house's cards may be both dealt face up. Again, the cards might be physical cards or video images of cards or the like. These cards comprise an initial house or dealer hand.

Play may then proceed in a conventional manner, with the player electing a next action. This action may comprise, for example, standing, taking one or more cards or "hits," making an insurance bet, or determining whether to split pairs, to double down, or surrender.

In one or more embodiments of the invention, a player may make an insurance bet if the dealer's face up card is an Ace. This bet is generally made after the player's and dealer's cards have been dealt, but before other cards have been dealt. In accordance with this bet, a player may wager an amount, such as one-half of their original wager or ante, as insurance against the dealer having a Blackjack (i.e. two card count of 21). If the dealer has a Blackjack, unless the player also has a Blackjack, the player loses on his original wager or ante, but is paid a winning at 2:1 on his insurance bet. In one embodiment, if the dealer has a Blackjack, the game is over. The player loses on their original wager or ante unless the player also has a Blackjack, in which event a "push" is declared, and those players are refunded their original wager or ante. If the dealer's hand is not a Blackjack, then the player loses their insurance bet and then the game continues.

In one or more embodiments, a player may be permitted to surrender. In particular, in one embodiment of the game, a player may concede their hand, announcing a surrender and forfeiting some of their wager or ante, such as one-half of their wager. In one embodiment, a player is not permitted to surrender in the event the dealer has a Blackjack.

In one or more embodiments, a player may be permitted to "double down." If the player's first two cards have a predetermined count, such as 9, 10 or 11 (or in other embodiments, only 10 or 11, or only 11) then the player may be permitted to make a second wager equal to their first wager (i.e. double-down). The player is then dealt a single additional card, and the three cards then comprise the player's hand for purposes of determining if the player's hand is a winning hand or losing hand.

In one or more embodiments, a player may be permitted to "split pairs." If the player's first two cards are a pair, then the player may be permitted to split the pair of cards, which each of the cards of the pair forming one card of each of two separate hands. The player's original wager or bet is applied to one of the hands, and the player is required to place a second wager to play the second hand. The player is dealt a second card for the two split hands, and then the two hands are treated just as single hands during the play of the game. For example, the player may stand or elect to take additional cards for either hand. In one embodiment, a player may be permitted to split a pair of Aces, but the player may be entitled to receive only a single additional card (i.e. form a two card hand). An exception to this rule may be that if the player receives a second card which is an Ace, the player may be permitted to split the hands again, or may be permitted to receive additional cards for the hand, as desired.

In one embodiment, a player may be permitted to split pairs received on already split hands. For example, if a player splits a pair of Fours into a first hand and a second hand and then receives another Four in relation to either the first hand or second hand, the player may then split that hand, resulting in the player having three hands.

In one embodiment, a player may be permitted to "double down" on a split hand in similar manner to a conventional single hand. For example, if the player splits a pair of Sixes into a first hand and a second hand and then receives a Four with respect to one of the hands, the player may be permitted to double down and receive a single third card to form the three card hand.

With respect to the player's hand (or hands, in the case of splits), the player may also stand or take one or more additional cards or "hits." If the player is satisfied with their hand, they may elect to stand and not take any additional cards. The determination of whether the player's hand is a winning hand is then made in accordance with the conventional rules of Blackjack detailed below.

A player may also elect to take one or more cards (such as by indicating to a dealer at a table, or via input to a gaming machine). If the player elects to receive additional cards at their turn, the dealer deals the additional cards. If the player's card count exceeds 21 at any time, then the player's hand is a losing hand and the player loses their wager. If the player's card count is less than 21 when they stand (i.e. stop taking additional cards) then the determination of whether the player's hand is a winning hand is made in accordance with the conventional rules of Blackjack detailed below.

Generally, the treatment of the house or dealer hand is in accordance with predetermined rules. In accordance with conventional rules, the dealer must generally take additional cards if the dealer's card count is less than 17 (i.e. 16 or less). If upon taking additional cards the dealer's hand exceeds a card count of 21, then the dealer's hand is a losing hand and the player's hand (or hands) is declared a winning hand.

In one embodiment of the game, an exception to the above-stated rule may be that the dealer must take additional cards when the dealer's hand is a "soft" 17. By "soft" it is meant that the dealer has received a card count of 17 comprising an Ace and one or more other cards totaling a count of six.

In accordance with the game, the outcome is determined by comparing the player's hand (or hands) with the dealer's hand after all cards have been dealt. If the player's hand is closer to a card count of 21 than the dealer's, without going over 21, then the player's hand is declared a winning hand. If the count of the player's hand and the dealer's hand are the same, then a "push" is declared. The game is ended for that player and the player's wager is returned.

In one embodiment, if a player's hand is a winning hand and is other than a Blackjack (i.e. other than a two card 21, such as a three or greater card count of 21), then the player may be awarded winnings, such as a payout equal to the player's wager or bet, i.e. at 1:1.

In the event a player's hand is a Blackjack (i.e. a two card hand with a count of 21—i.e. an Ace and any ten value card) and the dealer's hand is a Blackjack, then in a preferred embodiment, a push is declared and the game is over and the player's wager or ante is returned. If the player's hand is a Blackjack and the dealer's hand is not, then the player's hand is a winning Blackjack hand. Preferably, the player is paid or awarded winnings, such as a payout of 1:1, 3:2, 6:5 or 2:1 of the player's wager.

Each Blackjack game may be played with a single standard deck of 52 cards (either physical cards or representations thereof in a gaming machine environment). In other embodiments, the game may be played with multiple decks of cards.

It will be appreciated that a player may be "paid" or awarded winnings in a variety of manners. For example, the player may be awarded chips or other forms of credit, as well as currency. In this regard, the terms "pay" or "paid" and the like are meant to also mean "award."

Of course, each Blackjack game can be played in various manners, such as with other features than as described above or in other manners. For example, the cards may be dealt in different fashions (such as different combinations of cards dealt face-up, face-down or the like).

In a step S2, it is determined if a trigger has occurred. In a preferred embodiment, the bonus is a bonus activating trigger. If the bonus trigger has not occurred, then the game returns to step S1. If so, then game moves to step S3, as described below. In one embodiment, the trigger comprises the receipt of one or more bonus event elements, which elements preferably comprise one or more Blackjack game hands or combinations of cards. In a preferred embodiment, the trigger comprises the receipt by the player of at least one designated hand or combination of cards. In other embodiments, the trigger could comprise the receipt by the house or dealer of at least one designated hand or combination of cards. In other embodiments, the trigger could be random or be other events.

In a preferred embodiment, the trigger comprises the receipt by the player or dealer of a designated bonus element from a set of bonus elements, such as a designated hand of cards from a set of two or more designated hands. For example, in a preferred embodiment, the designated bonus elements are Blackjack hands (i.e. Blackjack game hands comprising two card hands with a count of 21), such as the hands A♦J♦, A♥J♥, A♣J♣ and A♠J♠. The trigger occurs or is met if the player or dealer receives one of these hands.

If the trigger has occurred, then in a step S3, it is determined if the bonus event is still in effect. In one embodiment, a bonus event of the invention remains in effect for a bonus period. The bonus period might comprise a period of time or a number of games or hands. For example, once the trigger occurs, a timed bonus period may start, such as a period of minutes. As another example, once the trigger occurs, a number of remaining games/hands may be defined.

If the bonus period has expired, then the game reverts to step S1 where a player may play another Blackjack game as described above (i.e. a Blackjack game played outside of the bonus event).

If the bonus period has not expired, then in a step S4, a player may play another Blackjack game (which game is played inside or during the bonus event). This game may be played in a similar manner to that described above. Once again, if the outcome of that individual Blackjack game is a winning outcome, the player may be paid or awarded winnings.

In a step S5 it is also preferably determined whether the player has achieved a bonus winning outcome during the bonus period. If not, then the method continues to step S3. If so, then in a step S6, a bonus award may be paid or awarded to the player.

In one embodiment, the bonus winning outcome comprises the receipt of one or more additional designated bonus elements Preferably, the one or more additional bonus elements comprise the remaining designated bonus elements (to the previously received bonus element which comprised the triggering element). As one example, four bonus elements may be defined, such as the hands A♦J♦, A♥J♥, A♣J♣ and A♠J♠. As indicated above, the triggering event may comprise the receipt of any one of these hands of cards. The bonus winning outcome may comprise the receipt of the remaining three hands of cards during the bonus period.

As indicated in step S6, if such an outcome or result is achieved, then the player may be awarded a bonus award. Preferably, the bonus award is a large amount, such as a jackpot (i.e. an award which is much higher than the player can normally achieve during normal game play). Such an award may be a fixed amount or might be a progressive or variable amount (i.e. an amount that varies over time, such as growing in size based upon the number of games played, the amount of time between bonus winning outcomes or the like).

Additional aspects of the invention will be described below. As indicated herein, the game may be presented and played using physical playing cards, such as at a game table.

As indicated, in one embodiment, the method of the invention may be implemented at a table. The table may include a felt or other printed or illustrated layout. The table and layout may include dealer and one or more player positions, as well as card and bet positions. The method may include use of the table and layout such as, for example, dealing the cards to the card positions. In such a configuration, the game could be presented to multiple players, such as with bonus events applying to each individual player.

However, in a preferred embodiment, the game is presented and played at a gaming machine. Such a gaming machine may have various configurations.

The gaming machine may be located at a casino (and as such is referred to as a "casino gaming machine"). The gaming machine may be part of a gaming system, such as a casino gaming system which links multiple of the gaming machines, one or more table games and other devices such as kiosks, accounting systems or servers, progressive systems or servers, player tracking systems or servers or the like.

Figure 3:
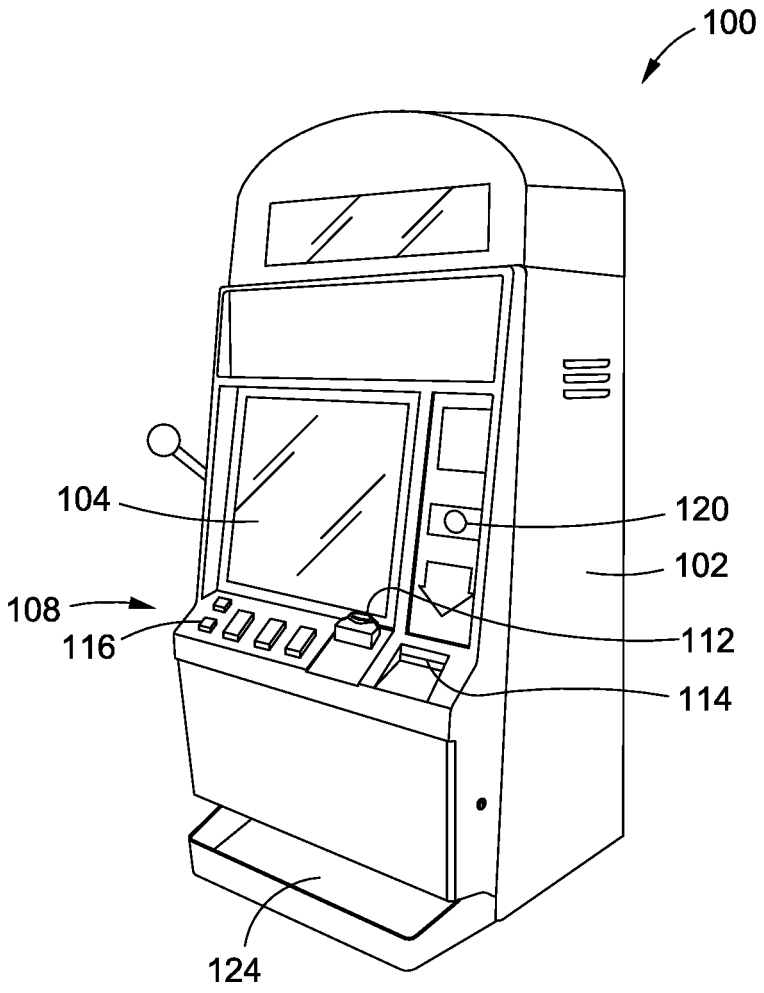
FIG. 3 illustrates an embodiment of a gaming machine at which a game of the invention may be presented and played.

One configuration of a gaming machine 100 is illustrated in FIG. 3. As illustrated, the gaming machine 100 generally comprises a housing or cabinet 102 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 100 may vary. In the embodiment illustrated, the gaming machine 100 has an "upright" configuration. However, the gaming machine 100 could have other configurations, shapes or dimensions (such as being of a "slant"-type, "bar-top" or other configuration as is well known to those of skill in the art).

The gaming machine 100 preferably includes at least one display device 104 configured to display game information. The display device 104 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touchscreen, a light emitting display (LED) or other suitable displays now known or later developed, in a variety of resolutions, sizes and formats (e.g. 4:3, widescreen or the like). The display 104 may be capable of projecting or displaying a wide variety of information, including images, symbols and other indicia or information associated with game play, game promotion or other events.

As described in more detail below, the gaming machine 100 is preferably configured to present one or more games upon a player making a monetary payment or wager. In this regard, as described in more detail below, the gaming machine 100 includes means for accepting monetary value.

In one embodiment, as detailed above, certain game outcomes may be designated as winning outcomes. Prizes or awards may be provided for winning outcomes, such as monetary payments (or representations thereof, such as prize of credits), or promotional awards as detailed herein. As detailed below, the gaming machine 100 includes means for returning unused monetary funds and/or dispensing winnings to a player.

The gaming machine 100 preferably includes one or more player input devices 108 (such as input buttons, plunger mechanisms, a touch-screen display, joystick, touch-pad or the like). These one or more devices may be utilized by the player to facilitate game play, such as by providing input or instruction to the gaming machine 100. For example, such input devices 108 may be utilized by a player to place a wager, cause the gaming machine 100 to initiate a game, to indicate cards to be held or discarded, to "cash out" of the gaming machine, or to provide various other inputs.

In one preferred embodiment, the gaming machine 100 includes at least one microprocessor or controller for controlling the gaming machine, including receiving player input and sending output signals for controlling the various components of the machine 100 (such as generating game information for display by the display 104). The controller may be arranged to receive information regarding funds provided by a player to the gaming machine, receive input such as a purchase/bet signal when a purchase/bet button 116 is depressed, and receive other inputs from a player. The controller may be arranged to generate information regarding a game, such as generating game information for display by the at least one display 104 (such as information representing images of displayed cards), for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device. The memory may also store other information, such as pay table information. The gaming machine 100 may also include one or more random number generators for generating random numbers, such as for use in selecting cards and for presenting the game in a random fashion.

Preferably, the controller is configured to execute machine readable code or instructions which are configured to implement the method of game play of the invention. For example, the controller of the gaming machine 100 may be configured to detect a wager, such as a signal from a player's depressing of the "bet one" button. Upon such an event and/or the player otherwise signaling the gaming machine to present the game, the controller may be configured to cause cards to be dealt/displayed on the at least one display 104. The controller may accept input from a player of a request to split, buy insurance, obtain additional cards or the like via the one or more player input devices 108 of the gaming machine 100.

The gaming machine 100 may be configured to generate and present games in a stand-alone manner or it may be in communication with one or more external devices at one or more times. For example, the gaming machine 100 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 100 is configured to present one or more wagering games. Thus, the gaming machines 100 is preferably configured to accept value, such as in the form of coins, tokens, paper currency or other elements or devices representing value such as monetary funds. For example, as illustrated in FIG. 3, the gaming machine 100 might include a coin acceptor 112 for accepting coins. Of course, associated coin reading/verifying devices and coin storage devices may be associated with the gaming machine 100 if it is configured to accept coins. Likewise, the gaming machine 100 might include a media reader 114. Such a reader may be configured to accept and read/verify paper currency and/or other media such as tickets. Of course, in such event the gaming machine 100 may further be configured with one or more paper currency or ticket storage devices, such as cash boxes, and other paper currency or media handling devices (including transport devices).

The gaming machine 100 might also be configured to read FOBs, magnetic stripe cards or other media having data associated therewith and via which value or funds may be associated with the gaming machine 100.

In one embodiment, the gaming machine 100 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 100 dispensing coins to a coin tray 124. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

The gaming machine 100 may also include a player tracking device, such as a card reader and associated keypad 120. Such player tracking devices are well known and may permit the game operator to track play of players of the gaming machine. The tracked play may be utilized to offer player bonuses or awards.

It will be appreciated that the gaming machine illustrated in FIG. 3 is only exemplary of one embodiment of a gaming machine. For example, it is possible to for the gaming machine to have various other configurations, including different shapes and styles and having different components than as just described.

For example, it is possible for the game of the invention to be presented on a computing device, including at a home or office computer, a kiosk or other types of devices. For example, the game might be presented via an application running on a computing device, or in a server-based or "Internet" environment. In one embodiment, a player might log in to a casino server and the controller of the casino server may cause game information to be delivered to the player's computer and then be displayed on a display of the player's computer. In this regard, it will be noted that the term "controller" may comprise more than one device. For example, in a server-based environment, a controller at a server may generate game information and transmit that information to a local controller at a gaming machine. The local controller at the gaming machine may then cause game information to be displayed on the display of the gaming machine. The games of the invention could also be presented by or at hand-held devices, such as PDAs, cellular phones, tablet computing devices or the like.

A casino may have numerous such gaming machines 100, such as located on a casino floor or in other locations. Of course, such gaming machines 100 might be used in other environments, such as an airport, a bar or tavern or other locations.

One example of the invention will be described with reference to FIGS. 2A and 2B. In this example, the game is being presented to a player of a gaming machine, such as the gaming machine 100 described above.

In this example, the designated bonus elements 206 comprise the four hands A♦J♦ 208, A♣J♣ 210, A♠J♠ 212 and A♥J♥ 214. The receipt of any one of these designated hands (such as by the player or the dealer, as the rules may be defined) triggers the bonus event and starts the bonus period. During the bonus period, the remaining three designated hands must be achieved in order to receive a bonus winning outcome.

Figure 2A:
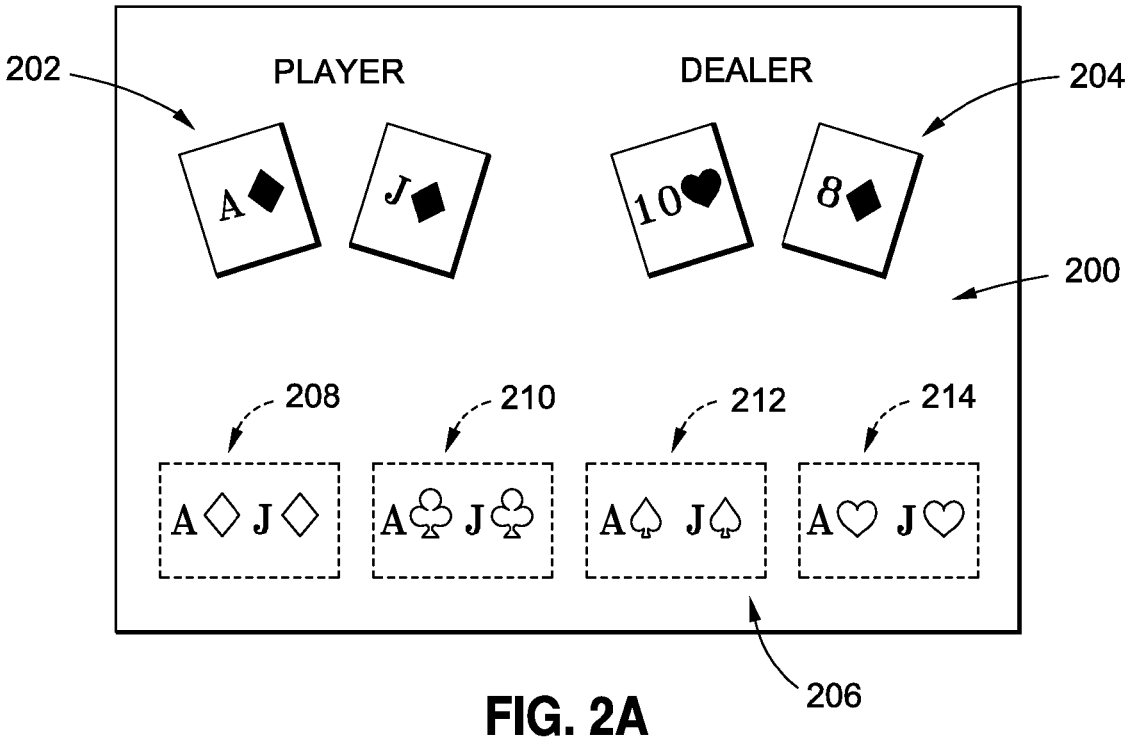
FIGS. 2A and 2B illustrate examples of game play in accordance with an embodiment of the invention.
Figure 2B:
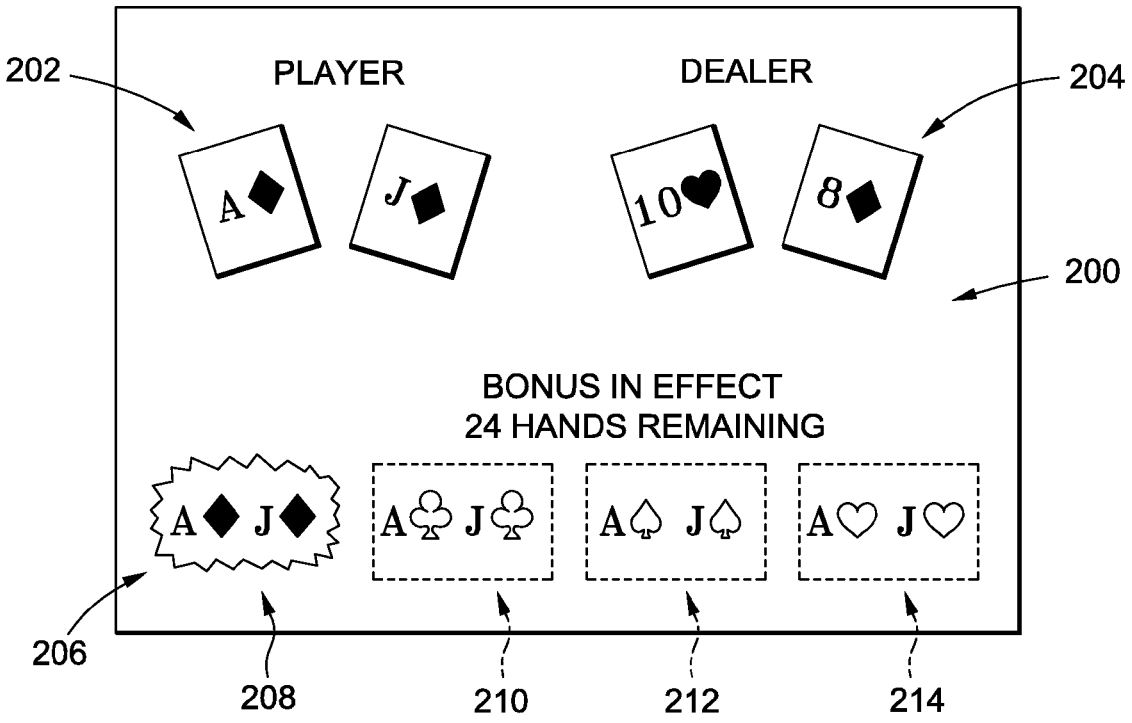

In the example of FIG. 2A, the player has placed any required wager and, as a result, a Blackjack game has been presented to the player. As illustrated, this included the display to the player of a player hand of cards 202 and a dealer or house hand of cards 204, such as via a graphical display 204. As illustrated, the player received a Blackjack (a two card count of 21) with the cards A♦J♦. This hand beat the dealer or house hand of 10♥8♦ which only had a card count of 18.

Preferably, as a result of the outcome of this first game, the player was awarded winnings for a winning Blackjack game. In addition, the receipt of the A♦J♦ hand by the player resulted in a bonus triggering event.

As illustrated in FIG. 2A, as a result of the triggering event, the A♦J♦ hand 208 has been highlighted or some other visual indication is provided that this particular hand has been received/achieved. In addition, a notification has been provided that the bonus event is in effect. In one embodiment, this may comprise text, such as "Bonus in Effect" plus information about the bonus event. This information may include how long the bonus remains in effect, i.e. the bonus period. In this example, the player has been given 25 hands or games of Blackjack to receive the remaining bonus hands of A♣J♣ 210, A♠J♠ 212 and A♥J♥ 214.

If the player plays additional Blackjack games and all of these additional bonus hands are achieved within the required bonus period (i.e. within 25 games or hands in this case), the player is preferably declared a winner of the bonus event and may be awarded bonus winnings.

The invention may have various implementations.

Figure 4A:
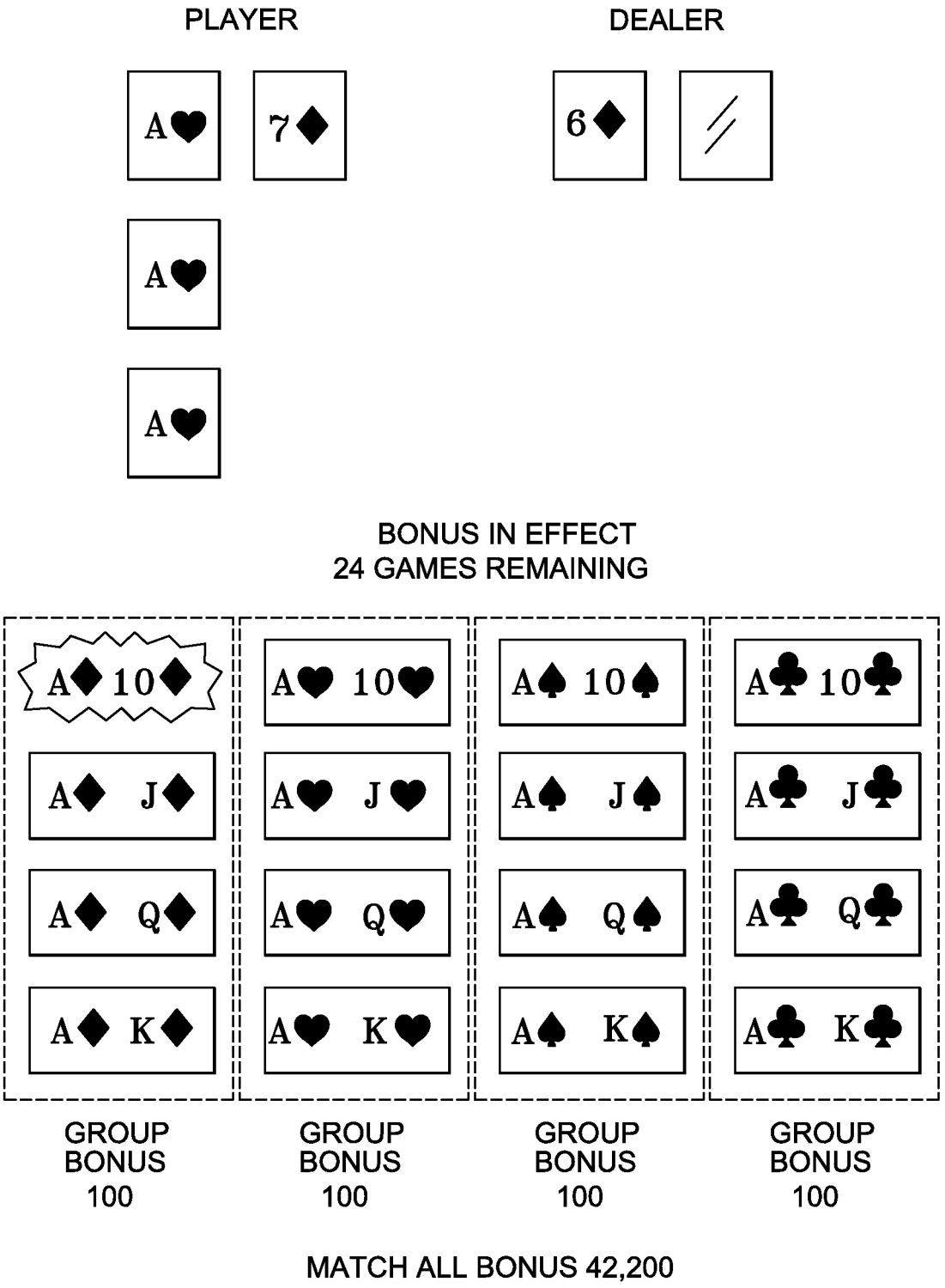
FIGS. 4A and 4B illustrate another example of game play in accordance with an embodiment of the invention.
Figure 4B:
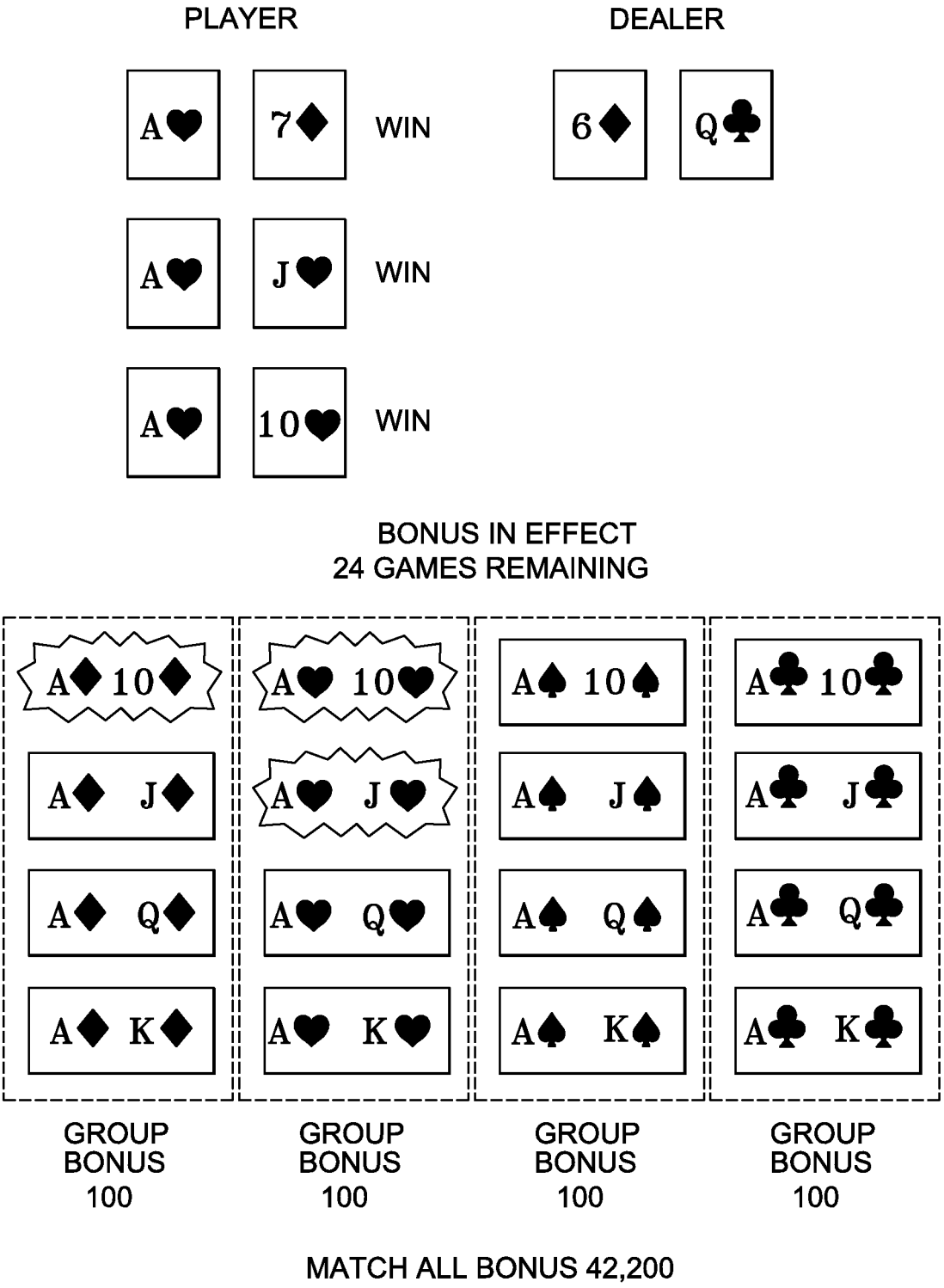

In one embodiment, there are at least two bonus game elements, whereby the receipt of at least one of the elements may comprise a trigger and the receipt of at least one other designated element is required to achieve a bonus winning outcome. In a preferred embodiment, the bonus game elements comprise two or more cards, hands or combinations of cards, wherein receipt of one or more of those bonus elements comprises a triggering event and receipt of the remaining bonus game elements comprises a bonus winning outcome or event. As indicated above, the bonus game elements might comprise the Blackjack hands A♦J♦, A♣J♣, A♠J♠ or A♥J♥, but might comprise other hands, such as A♥K♥, A♥Q♥, A♥J♥, and A♥10♥, or various other hands (including hands which are not "Blackjacks", such as the hand 6♥6♦) or the like. While there could be as few as two bonus elements, there may be three, four (as described above relative to the preferred embodiment) or even more than four elements (such as six hands). For example, as illustrated in FIGS. 4A and 4B, in one embodiment there might be 16 bonus elements comprising each of the Blackjack hands AK, AQ, AJ and A10 in each of the four suits (♠♣♥♦). In another embodiment, the bonus elements might comprise all two-card Blackjack hand permutations of AK, AQ, AJ and A10 in all suits, or 64 bonus elements.

In one embodiment, a player may be required to achieve a bonus element to comprise a triggering event and may then still be required to achieve that and/or other bonus elements in order to win the bonus. For example, if the bonus elements comprise the hands A♥J♥ and A♠J♠ and the player receives the A♥J♥ as a triggering event, the player may still be required to achieve both hands again in order to achieve a bonus winning outcome.

As indicated above, in one embodiment, bonus elements may only be collected or received by a player. In another preferred embodiment, the bonus elements may be received by the player or the dealer or the player and dealer. For example, a dealer might receive the hand A♥J♥, thus comprising a triggering event. The player might then receive the remaining hand or hands which are required for a bonus winning outcome. An advantage of this configuration is that a player can be moved into a bonus event, towards a bonus winning outcome, or may achieve a bonus winning outcome, through hands or cards which the player himself does not achieve.

In this regard, the game could be implemented in a multi-player environment, such as in the case of on-line video Blackjack. In such an event, a bonus event might be triggered by the receipt of a designated bonus element by the dealer or any player to the game. All players might then enter the bonus event, wherein the receipt by the dealer or any player of the remaining bonus elements counts towards the bonus winning outcome. The bonus award might be awarded to the player who receives the last remaining designated bonus element, or the bonus award might be split or divided (equally, based upon a pro-rata share of bonus elements achieved by each player, etc.).

Games of the present invention can be presented in other variations or configurations. Another embodiment of the invention is illustrated in FIGS. 4A and 4B. At one or more times a player may play multiple games or hands. In one preferred embodiment, if one of the cards in a player's initial two card hand (i.e. either the first card or second card dealt to the player) is a card which forms a part of one of the bonus elements, the player can re-use that card in one or more additional hands. As one example, referring to FIG. 4A, a bonus period is active, with the player having 24 hands or games remaining in the bonus period and the player having already captured the bonus element A♦10♦. The player has been dealt an initial two-card Blackjack hand comprising A♥7♦. Because the A♥ is a card which is in one or more of the bonus elements (such as the bonus element hands A♥K♥, A♥Q♥, A♥J♥ and A♥10♥), the player has been permitted to re-use that card in one or more additional hands. In this case, the player has been permitted to re-use that card in two additional hands.

The hands or games are then completed, as illustrated in FIG. 4B. As illustrated therein, the player stood on the initial hand. The player was dealt the J♥ in the second hand and was dealt the 10♥ in the third hand. The dealer stood on the dealer's hand of 6♦Q♦ (having a card count of 16). As a result, the player won the first hand (A♥7♦ having a higher card of 17), and thus was paid winnings for that winning hand. That winning first hand, however, did not comprise one of the bonus elements. The player won the second hand with a Blackjack hand of A♥J♥, and the player may thus be paid winnings for that winning hand. This hand comprised one of the bonus elements and is so indicated to the player. The player also won the third hand with a Blackjack hand of A♥10♥ and the player may thus be paid winnings for that winning hand. This hand also comprised one of the bonus elements and is so indicated to the player.

In one embodiment, the player may be required to place a wager in order to enable the additional hand feature and/or place a wager to play each additional hand or game. For example, a player might place a wager of $0.25 to play a hand of Blackjack. If a designated card is received the player might be required to place an additional wager of $0.25 in order to play each additional hand.

FIGS. 4A and 4B illustrate an example where a player is given the opportunity to play two additional hands. However, the player might be permitted to play only a single additional hand or more than two additional hands.

In one embodiment, the player may elect whether to play one or more additional hands. In other embodiments, the hands might automatically be generated. In one embodiment, this feature of the invention might only be active during a bonus period. Thus, in the above example if the player received the A♥ during play of a game outside of the bonus period, then the card would not be re-used in additional hands. However, in other embodiments this feature of the invention could be active at all times.

While FIGS. 4A and 4B illustrate examples in which the bonus element card from the player's first hand is duplicated (such as by being re-displayed) into additional hands, the card could be re-used in other fashions (i.e. the same card value, whether re-displayed, re-dealt, etc. is used in the determination of the outcome of one or more other hands). For example, the bonus element card need not be re-displayed on the display but could be displayed only a single time while being combined with other cards to form more than one hand. In another embodiment of the invention, the player's initial hand might be displayed multiple times.

In the example which is illustrated in FIGS. 4A and 4B, the player did not "hit" any of the hands to receive more than two cards. However, in various embodiments the player may receive additional cards in any or all of the hands or otherwise exercise Blackjack game rules applicable to the hands. In other embodiments, the player might only be dealt one additional card in the additional hands, thus permitting the player to only receive a two-card Blackjack hand.

In one embodiment, a player might receive more than one bonus element in a hand. For example, the player might be dealt the hand A♥J♥. The player might be permitted to re-use the A♥ in one or more additional hands, or the J♥ in one or more additional hands (or use each card in different hands), such as depending upon the bonus elements which the player is attempting to achieve.

As indicated above, in one embodiment a player may be given a period of time or a number of games or hands in order to achieve the bonus winning element(s). An advantage of this embodiment of the invention is that the re-use of one or more cards which are part of one or more of the bonus elements may improve the player's chances of achieving the bonus elements. First, by re-using one of the cards which forms one or more the bonus elements, the player has an improved chance of forming the complete bonus element (than if the cards or other game elements are randomly drawn or dealt). Second, the re-use of the card in multiple hands as part of the same game results in a greater number of chances to achieve bonus elements in a given period of time (as compared to playing successive different games or hands). In an embodiment where a player is given a number of games to achieve the bonus elements, the additional hands may not count against the player (i.e. do not reduce the number of remaining games). For example, as illustrated in FIGS. 4A and 4B, the player has 24 games remaining in the bonus period. While the player has been given the opportunity to play three hands in this one game, the number of hands which are remaining in the bonus period has not decreased as a result of those additional hands. In yet another embodiment where the receipt of a bonus element increases the time or number of hands or games which the player has to capture the bonus elements, the multiple hands may result in bonus elements which provide the player with additional time or hands/games.

While in a preferred embodiment the additional hand opportunity is triggered by receipt of a card which is one of the cards in one or more bonus elements, the player could have the opportunity for additional hands in each game.

One advantage of a preferred embodiment of the invention is that a player has an opportunity to win each individual Blackjack game and be paid winnings for each winning Blackjack game outcome. In addition, however, a player has a chance for a separate bonus winning outcome and associated award. Thus, even though it might take a player 35 games to achieve the bonus winning outcome, the player might additionally be paid winnings for winning outcomes of 25 of the 35 games.

In an embodiment where the player is allowed to play multiple hands through re-used cards, the player might only have the opportunity to obtain winning bonus elements via the additional hands, but not be paid winnings if those hands beat the dealer's hand (since the player is allowed to duplicate one or more good starting cards for those hands, the odds of winning are much higher than if the cards were dealt randomly for those hands).

In one embodiment, when a player receives one of the bonus elements after the triggering event, they might be provided additional time, games or hands to achieve a bonus winning outcome. For example, a player might initially be given 25 hands to receive a bonus winning outcome. However, after 3 hands a player might achieve one of the other bonus elements and be provided an additional 10 hands, thus raising the number of hands that the player has remaining to achieve a bonus winning outcome to 32 hands.

In one embodiment, a player might be paid winnings for receiving each bonus element, in addition to winnings for winning outcomes of each Blackjack game and in addition to a bonus event game win. For example, the bonus event might define four bonus elements, such as four bonus hands. When one of those hands is received as a triggering event and when one of those hands is received during the bonus event, the player might be awarded winnings, such as a number of credits (and as indicated above, if the last bonus element is received during the bonus event, the player may thus be awarded winnings for receiving that bonus element and also the bonus award or jackpot for achieving the bonus winning outcome). In this configuration, a player is enticed to not only play each individual Blackjack for a winning outcome, but to play games to achieve a payout for receiving any one of the bonus elements (and, to play out the bonus period for the chance to win the bonus jackpot).

In another embodiment, a player might be paid a small bonus or winnings, such as a "hand bonus" (in addition to any award for the individual game outcome) for receiving each bonus element and/or for receiving an already received bonus element. For example, the bonus elements might comprise A♥J♥, and A♦J♦. For achieving the A♦J♦ as a triggering outcome, the player might be paid a small bonus award, such as 25 credits. Thereafter, the player might receive the A♦J♦ again before receiving the A♥J♥. For receiving the A♦J♦ the second time, the player might be paid a small bonus or award, such as an additional 10 credits (or other value) in addition to any winnings for the particular game in which the player received that hand.

Another example is illustrated in FIGS. 4A and 4B. In this embodiment there are 16 bonus elements. There are four sub-groups of bonus elements. In this embodiment those sub-groups comprise the Blackjack hands of cards of the same suit. In this configuration, a player may be paid winnings for a winning Blackjack hand and/or additional winnings for that hand comprising any one of the bonus elements. If the player completes a "suite" of all of the bonus elements of one suit (e.g. all four bonus elements in one of the groups), then the player may be paid an additional award, such as a group bonus. Such a bonus might comprise a fixed award, such a fixed number of monetary value credits. Alternatively, the bonus might comprise a progressive jackpot. Such a jackpot preferably has a value which changes, such as increasing over time if it is not won. Such a jackpot might be funded by a portion of wagers such that each occurrence of the game where the bonus is not won causes the progressive jackpot value to increase. A progressive jackpot might be applicable to a single machine or it might be applicable to a large number of linked gaming machines. If the player completes or receives all of the bonus elements, then the player is preferably awarded the main bonus award. In a preferred embodiment, the main bonus award is also a progressive jackpot. Of course, other variations of bonus elements and associated awards might be provided.

As indicated above, the bonus event preferably remains in effect for a period of time, a number of games/hands or the like. An advantage of utilizing time is that if the player leaves the gaming machine, another player cannot readily capitalize on the bonus event (since it will expire quickly; whereas if the bonus event last a number of games, the bonus event remains in effect event when the gaming machine is not played for a long period of time). In one embodiment, the bonus event could remain in effect for a number of games, but it could also remain in effect for a number of hands. For example, in the case of a game where the player "splits" and thus plays two hands, both hands of that game would decrement the remaining number of hands in the bonus event.

The bonus event awards may be funded in various manners. In one embodiment, the bonus event awards may be funded from a portion of wagers for base Blackjack games. In other embodiments, a player might be required to place a separate or larger wager to be entitled to play the bonus event, which separate or larger wager may be used to fund the bonus event awards. For example, if the normal wager or ante for the Blackjack game is $0.50, the player might be required to wager or ante $0.75 in order to play a game and be entitled to participate in the bonus event (i.e. outcomes of games where the player does not place the required separate or larger wager cannot result in a triggering event, capture of a bonus element or the like).

The game of the invention has a number of benefits. Foremost, a Blackjack game is provided which offers a player a chance for winnings in addition to awards for winning individual games. The bonus of the invention, however, does not require the player to play other types of games, such as by using the cards of the Blackjack game to form non-Blackjack hands or the like. Instead, Blackjack game outcomes are directly used as the basis for the bonus event.

The bonus event of the invention entices players to play more Blackjack games in an attempt to win the bonus event. In particular, once the bonus event is triggered, the player is enticed to play games during the bonus time or to play the number of hands defined by the bonus event, in attempt to achieve a bonus win.

Aspects of the invention may be applied to games other than Blackjack, such as slot, poker (using physical cards or in video form), craps or the like, although the features of the invention are believed to be uniquely advantageous relative to games of Blackjack.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of presenting games at a gaming machine comprising the machine-implemented steps of:

accepting a wager from a player;

presenting a first Blackjack game on the gaming machine including displaying a player card hand and a house card hand on a display of the gaming machine;

determining on the gaming machine an outcome of said first Blackjack game;

if said outcome of said first Blackjack game is a winning outcome, awarding on the gaming machine a Blackjack game award to said player;

determining on the gaming machine if a triggering event has occurred, wherein if a triggering event has occurred, activating on the gaming machine a bonus event having a bonus period, said bonus event resulting in a bonus award if said player achieves at least one designated bonus outcome as a result of play of one or more Blackjack games during said bonus period, said at least one designated bonus outcome comprising at least one Blackjack game hand of cards; and presenting on the gaming machine one or more second Blackjack games, wherein each second Blackjack game comprises presenting a first hand comprising displaying on the display a player card hand comprising a first player card and a second player card, and a house card hand, wherein if either of said first player card or second player card comprises a card of one of said bonus outcomes, re-using said card in at least one second hand, finalizing said first hand and any second hand, determining the outcome of each player hand as compared to said house card hand and awarding a Blackjack game award to said player for each winning hand, and wherein if said player achieves said at least one bonus outcome during said bonus period, awarding on the gaming machine at least one additional bonus award to said player.

2. The method in accordance with claim 1 wherein said at least one designated bonus outcome comprises a two card Blackjack hand of an Ace card in combination with a King, Queen, Jack or 10 card.

3. The method in accordance with claim 1 wherein said designated bonus outcomes comprise the hands A♥K♥, A♥Q♥, A♥J♥,A ♥10♥, A♦K♦, A♦Q♦, A♦J♦, A♦10♦, A♣K♣, A♣Q♣, A♣J♣, A♣10♣, A♠K♠, A♠Q♠, A♠J♠, and A♠10♠.

4. The method in accordance with claim 1 wherein said designated bonus outcomes comprises two card hands having a total card count of 21.

5. The method in accordance with claim 1 wherein said triggering event comprises achieving one of said designated bonus outcomes.

6. The method in accordance with claim 1 wherein said step of determining if a triggering event has occurred comprises determining if said player or house card hand comprises at least one designated hand.

7. The method in accordance with claim 1 wherein said bonus period comprises a period of time.

8. The method in accordance with claim 1 wherein said bonus period comprises a number of games.

9. The method in accordance with claim 1 further comprising extending said bonus period each time said player achieves one of said designated bonus outcomes.

10. The method in accordance with claim 1 wherein said at least one second hand comprise a second hand and a third hand.

* * * * *